United States Patent [19]

Hufford

[11] Patent Number: 4,917,282

[45] Date of Patent: Apr. 17, 1990

[54] HOLDER FOR GOLF BALLS AND THE LIKE

[76] Inventor: Lynn Hufford, 807 S. Center St., Flora, Ind.

[21] Appl. No.: 154,222

[22] Filed: Feb. 10, 1988

[51] Int. Cl.[4] ..... B60R 11/00

[52] U.S. Cl. ..... 224/274; 224/919; 211/14; 217/35

[58] Field of Search ..... 224/274, 918, 919; 211/14; 294/148, 158; 217/35, 27

[56] References Cited

U.S. PATENT DOCUMENTS

| | | | |
|---|---|---|---|
| 1,324,828 | 12/1919 | Knostman | 217/35 |
| 1,426,246 | 8/1922 | Benedict | 217/35 |
| 1,572,383 | 1/1926 | Dennys | 294/148 |
| 1,926,916 | 9/1933 | Reeves | 211/14 |
| 1,955,650 | 4/1934 | Obarski | 224/918 |
| 2,228,493 | 1/1941 | Will | 206/564 X |
| 3,367,483 | 2/1968 | Studen | 217/27 X |
| 4,082,209 | 4/1978 | Sanders | 224/919 |
| 4,296,874 | 10/1981 | Evans | 224/919 |

FOREIGN PATENT DOCUMENTS

| | | | |
|---|---|---|---|
| 2752668 | 5/1979 | Fed. Rep. of Germany | 224/919 |
| 227180 | 1/1925 | United Kingdom | 224/919 |

*Primary Examiner*—Stephen Marcus
*Assistant Examiner*—C. A. Peterson
*Attorney, Agent, or Firm*—Woodard, Emhardt, Naughton Moriarty & McNett

[57] ABSTRACT

A ball holder made of resilient material with retention apertures of a slightly smaller size than the ball to be secured within the aperture, with retention of the ball being accomplished by frictional and radial compression forces being exerted upon the ball.

18 Claims, 1 Drawing Sheet

HOLDER FOR GOLF BALLS AND THE LIKE

BACKGROUND OF THE INVENTION

This invention relates to a holder for golf balls and the like and more particularly to a holder which uses frictional contact between a ball and the resilient walls of an aperture to secure the ball within the aperture.

Golfers often use more then a single ball in playing a round of golf. Besides replacing lost or cut balls, golfers often use a different ball for driving and fairway play than they use for putting. Additionally, golfers will occasionally use a floating ball or a shag ball for water shots, and then replace that ball with a different ball after the water hazard has been avoided. Most golf bags have an exterior zippered pocket within which golf balls may be stored. One problem with the zippered pockets is that if a particular ball is desired to be used for a particular shot, it is difficult to see within the pocket so that the specific ball may be selected. Thus, a golfer typically must remove several different balls from the zippered pocket before the desired ball is found. This invention addresses and solves the problems inherent with the lottery method of golf ball selection.

There are several types of golf ball holders available to golfers. These golf ball holders typically embody a channel that is sized to receive the golf ball. The channel has flexible jaws that expand upon insertion of the golf ball and contract to secure the ball within the channel. These holders are typically designed to be either secured to the golf bag by a chain or other strap or secured by rivets or magnets to a golf cart. One problem with these devices is that the plastic or spring metal used to make the jaws and channel can be easily broken. Additionally the plastic or spring metal can damage the leather or plastic from which the golf bag is constructed if the golf ball holder is placed within the zippered pocket of the golf bag between rounds.

Another type of golf ball holder is disclosed in a patent to Bennys (U.S. Pat. No. 1,572,383). This patent discloses a plate with aperture sized to receive a golf ball surrounded by an elastic band to hold the ball within the aperture. One problem with this device is that the plate must be made of a rigid material and therefore can easily be broken or may damage the golf bag if the golf ball holder is stored in the zippered pocket between rounds. An additional problem with the Bennys device is that, unless the elastic band is transparent, the band must be moved aside from the apertures to ensure that a specific desired ball may be selected.

The disclosed invention permits all the golf balls within the holder to be visually inspected at a glance, and is also designed to be virtually unbreakable and not cause damage to the interior of a golf bag if the holder is stored within a zippered pocket in the bag between rounds. None of the disclosed golf ball holders solve all of the problems solved by the present invention.

SUMMARY OF THE INVENTION

One embodiment of the present invention is a golf ball holder with a first surface that has a peripheral edge and a plurality of resilient openings in the first surface that are displaced from the peripheral edge. The openings have a diameter slightly smaller than the diameter of a ball to be secured therein. The holder has a second surface which faces in an opposite direction from the first surface and which is displaced from the first surface by a spacing means that extends between the first surface and the second surface. The spacing means has a plurality of resilient side walls located therein that define reception apertures which extend through the spacing means. The diameter of the reception apertures is slightly less than the diameter of the ball to be held therein. The reception apertures are located in the spacing means so as to be aligned with the circular openings in the first surface.

One object of the present invention is to provide a golf ball holder which allows for visual inspection of the balls held therein at a glance.

A second object of the present invention is to provide a resilient golf ball holder which may be stored in the zippered compartments of a golf bag without causing damage to the material of the bag.

Related objects and advantages of the present invention will be apparent from the following description.

DESCRIPTION OF THE PREFERRED EMBODIMENT

Figure 1:
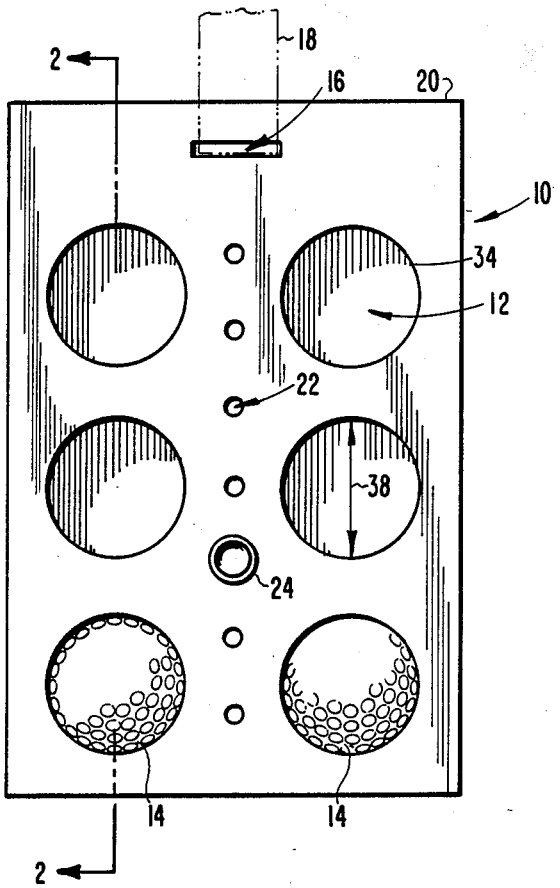
FIG. 1 is a front view of a ball holder according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a ball holder 10 for holding golf balls or the like. Ball holder 10 has a plurality of retention apertures 12, here illustrated as six, located therein. In the drawings, two of the retention apertures 12 secure golf balls 14.

While a single aperture 12 may be constructed to hold more than one ball, each illustrated aperture 12 is designed to hold a single ball. Ball holder 10 also has an attachment aperture 16 extending through the entire holder 10 so that an attachment strap 18 (illustrated in dotted lines) may be inserted therethrough and attached to the exterior of a golf bag or cart. Attachment aperture 16 is sufficiently displaced inwardly from the peripheral edge 20 of the holder 10 to prevent strap 18 from tearing through the material from which holder 10 is made. Also located in the ball holder 10 may be a plurality of tee holding apertures 22 (here illustrated as seven) of sufficient diameter and depth to hold a golf tee 24.

Figure 2:
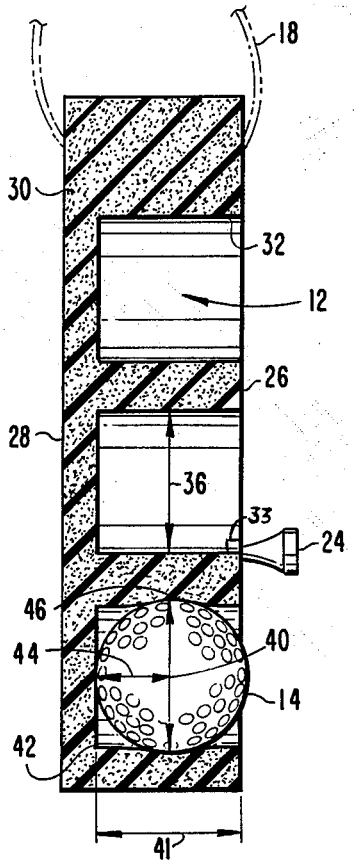
FIG. 2 is a cross sectional view of the ball holder of FIG. 1 along the line 2—2.

Ball holder 10 has a first surface 26 and an oppositely facing second surface 28 with spacing material 30 extending between the first surface 26 and second surface 28 (FIG. 2). Although other shapes may be satisfactory, retention apertures 12 are formed of cylindrical walls 32 which extend perpendicularly 33 from the first surface 26 into spacing material 30 and extend through first surface 26 as circular openings 34. The diameter 36 of the cylindrical walls 32 and the diameter 38 of circular openings 34 are slightly less than the diameter 40 of the ball 14 which will be secured in retention apertures 12 when the aperture is not subject to any external forces. The distance 41 between the bottom wall 42 of the retention aperture 12 and the first surface 26 is at least slightly greater than the radius 14 of the ball 14 which is to be held within retention aperture 12. The depth 41 of the retention aperture 12 preferably approximates the diameter of the ball to be held therein. Retention aperture 12 does not extend completely through spacing material 30 and the bottom wall 42 is sufficiently displaced from the second surface 28 to prevent tearing of the ball holder 10 under normal conditions. Also, retention apertures 12 are displaced sufficiently inward from the peripheral edge 20 of the holder 10 to prevent tearing under normal conditions. Additionally, each aperture 12, 16 and 22, is displaced sufficiently from every other aperture to prevent tearing under ordinary conditions.

Ball holder 10 is made from foam rubber to provide sufficient resiliency to the retaining apertures 12 to allow a ball 14 to be inserted through the circular opening 34 and be retained within the aperture 12 by frictional and compression forces exerted by the cylindrical walls 32 on the ball 14. Thus, when a ball 14 is retained in retention apertures 12, cylindrical walls 32 are temporarily displaced to create a deformation 46. Deformation 46 is formed by compression of spacing material 30. Because of the resiliency of spacing material 30, diametrically opposed inward radial forces are supplied around the diameter of the ball 14. Upon removal of the ball 14, cylindrical walls 32 again assume their cylindrical shape.

Removal of the ball 14 from a selected retention aperture 12 is accomplished by applying a force to the second surface adjacent the selected retention aperture. The force is directed toward the first surface. Because of the resiliency of the second surface 28 and the spacing material 30, the force is transferred from the bottom wall 42 to the wall 12 which is subsequently forced from the retention aperture.

As can be seen from FIG. 1, balls 14 may be placed within cylindrical aperture 12 so that the various balls held within the ball holder may be inspected at a glance and a desired ball may easily be chosen from the ball holder. Additionally, since the ball holder 10 is made of resilient material such as foam rubber, if the ball holder is stored in compartments within a gold bag between rounds, there will be no damage to the golf bag and the ball holder will not be broken should a sharp blow be received by the bag.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for holding golf balls, comprising:

a substantially solid block of resilient material having a thickness, a first surface, an oppositely facing second surface and a retention aperture extending into said substantially solid block from said first surface, said retention aperture having a dimension measured parallel to said first surface which is slightly smaller than the diameter of a golf ball to be held therein; and, radial compression retention means for securing a golf ball within said retention aperture by oppositely directed radial compression forces being exerted by the retention aperture on diametrically opposed points on the ball.

2. The device for holding golf balls of claim 1 wherein said retention aperture has a depth measured from said first surface which is greater than the radius of the ball to be held therein but less than the thickness of the body portion.

3. A device for holding golf balls, comprising:

a substantially solid block of resilient material defining a plurality of spaced apart, open-ended, retention cavities, each of said cavities having a minimum width slightly smaller than the diameter of a golf ball and having a substantially average depth at least slightly greater than the radius of a golf ball, the device adapted for support proximal to a golf bag such that said cavities open horizontally and firmly retain golf balls therein without any additional, external structure aiding said block to retain its shape and the balls.

4. The device for holding golf balls of claim 3 wherein said body is a polyhedron and said cavities are cylindrical.

5. A method for storing and manually accessing golf balls, comprising the steps of:

providing a substantially solid block of resilient material defining a plurality of spaced apart, open-ended, retention cavities, each of said cavities extending into said block, having a minimum width slightly smaller than the diameter of a golf ball and having a substantially average depth at least slightly greater than the radius of a golf ball;

supporting said block proximal to a golf bag such that said cavities open horizontally; and manually pressing at least one golf ball into a corresponding one of said cavities, said golf ball thereby being frictionally held in said corresponding one of said cavities, a portion of said golf ball being visible from the exterior of said block.

6. The method for storing and manually accessing golf balls of claim 5 wherein said providing step includes said block defining a front surface and an opposing back surface with said cavities opening through said front surface and wherein said body is a polyhedron and said cavities are cylindrical.

7. The method for storing and manually accessing golf balls of claim 6 further including the step of removing said at least one golf ball from said corresponding one of said cavities by manually compressing said body between at least two points, one of said at least two points being on said back surface behind said corresponding one of said cavities and another of said at least two points being on said front surface adjacent said corresponding one of said cavities.

8. A device for holding golf balls, comprising:

a substantially solid block of resilient material defining at least two spaced apart, ball retention cavities extending into said block, each of said cavities having a minimum width slightly smaller than the diameter of a golf ball and having a depth at least slightly greater than the radius of a golf ball, said block adapted to firmly retain golf balls within said cavities in all aspects of orientation of said block without external supporting structure applied thereto.

9. The device for holding golf balls of claim 8 wherein said block defines a first surface and said at least two cavities extend into said block from the first surface.

10. The device for holding golf balls of claim 9 wherein there are 6 cavities which all extend into said block from said first surface.

11. The device for holding golf balls of claim 9 wherein the depth of each of said cavities is at least substantially equal to the diameter of a golf ball.

12. The device for holding golf balls of claim 9 wherein the diameter of each of said cavities is substantially constant.

13. The device for holding golf balls of claim 9 wherein each of said cavities defines substantially cylindrical walls which extend substantially orthogonally into said block from said first surface and which are outwardly deformable to receive and firmly retain a respective golf ball.

14. The device for holding golf balls of claim 9 wherein said block defines a second surface opposite said first surface and wherein said cavities do not extend through said second surface.

15. The device for holding golf balls of claim 9 further including supporting means for supporting said block from a golf bag such that said cavities open horizontally.

16. A device for holding golf balls, consisting essentially of:

a substantially solid block of resilient material defining at least two spaced-apart, ball retention cavities extending into said block, each of said cavities having a minimum width slightly smaller than the diameter of a golf ball, and having a depth at least slightly greater than the radius of a golf ball, said block adapted to firmly retain golf balls within said cavities in all aspects of orientation of said block.

17. The device for holding golf balls of claim 16 wherein said block defines a first surface and both of said at least two cavities extend into said block from the first surface.

18. The device for holding golf balls of claim 17 wherein there are six cavities, all of which extend into said block from the first surface.

* * * * *